US006959832B1

(12) United States Patent
Sawada et al.

(10) Patent No.: US 6,959,832 B1
(45) Date of Patent: Nov. 1, 2005

(54) LID MEMBER FOR FOOD CONTAINER

(75) Inventors: Kiyoshi Sawada, Osaka (JP); Mitsuo Yoshimura, Osaka (JP); Hirofumi Kawai, Osaka (JP); Takashi Takagi, Osaka (JP); Yuko Zenpuku, Osaka (JP)

(73) Assignee: Nissin Shokuhin Kabushiki Kaisha, Osaka (JP)

( * ) Notice: Subject to any disclaimer, the term of this patent is extended or adjusted under 35 U.S.C. 154(b) by 0 days.

(21) Appl. No.: 09/857,904

(22) PCT Filed: Dec. 9, 1999

(86) PCT No.: PCT/JP99/06890

§ 371 (c)(1),
(2), (4) Date: Oct. 1, 2001

(87) PCT Pub. No.: WO00/34149

PCT Pub. Date: Jun. 15, 2000

(30) Foreign Application Priority Data

| | | |
|---|---|---|
| Dec. 9, 1998 | (JP) | 10-349680 |
| Jan. 11, 1999 | (JP) | 11-004469 |
| Jan. 13, 1999 | (JP) | 11-006296 |
| Jan. 14, 1999 | (JP) | 11-007481 |
| Jan. 14, 1999 | (JP) | 11-007482 |
| Jan. 27, 1999 | (JP) | 11-018528 |
| Feb. 10, 1999 | (JP) | 11-032685 |

(51) Int. Cl.[7] ..... B65D 17/34

(52) U.S. Cl. ..... 220/359.2; 220/359.3; 220/266; 220/359.4; 426/115; 426/122; 428/43; 229/125.35

(58) Field of Search ..... 220/266, 271, 220/270, 359.1–359.4; 229/120, 125.35; 428/131, 134, 136–138, 40.1–42.3, 43; 426/115, 426/122

(56) References Cited

U.S. PATENT DOCUMENTS

| | | | | |
|---|---|---|---|---|
| 4,013,188 | A | 3/1977 | Ray | |
| 4,020,969 | A * | 5/1977 | Ando | 220/359.2 |
| 4,209,126 | A | 6/1980 | Elias | |
| 4,530,440 | A * | 7/1985 | Leong | 220/201 |
| 4,636,273 | A * | 1/1987 | Wolfersperger | 156/244.11 |

(Continued)

FOREIGN PATENT DOCUMENTS

| | | | |
|---|---|---|---|
| JP | 56-28154 | Y2 | 7/1981 |

(Continued)

OTHER PUBLICATIONS

International Search Report of PCT/JP99/06890.

(Continued)

*Primary Examiner*—Robin A. Hylton
(74) *Attorney, Agent, or Firm*—Marshall, Gerstein & Borun LLP

(57) ABSTRACT

A lid member for a food container having a layered structure in which a surface sheet is laid on a composite sheet, said surface sheet including an easily-peelable area that is easily separated from the composite sheet, formed by applying a lubricant between the surface sheet and the composite sheet, said surface sheet including a non-peelable area adjacent to said easily-peelable area; a first slit cut vertical-sectionally through the composite sheet, said first slit defining one or more apertures in said lid to form an opening area in said composite sheet; a second slit in said surface sheet defining a boundary between the easily-peelable area and said non-peelable area of said surface sheet; and said surface sheet being adhered to said composite sheet at said composite sheet opening area over an area that is smaller than said composite sheet opening area.

14 Claims, 13 Drawing Sheets

U.S. PATENT DOCUMENTS

| | | | | | |
|---|---|---|---|---|---|
| 4,735,335 | A | * | 4/1988 | Torterotot | 220/270 |
| 4,756,917 | A | | 7/1988 | Kamada et al. | |
| 4,771,937 | A | | 9/1988 | Kamada et al. | |
| 4,828,136 | A | * | 5/1989 | Kawahara et al. | 220/270 |
| 5,348,809 | A | * | 9/1994 | Oyagi et al. | 428/622 |
| 6,669,046 | B1 | * | 12/2003 | Sawada et al. | 220/270 |

FOREIGN PATENT DOCUMENTS

| | | | | |
|---|---|---|---|---|
| JP | 57-55175 | Y2 | | 11/1982 |
| JP | 60-9171 | Y2 | | 4/1985 |
| JP | 61-3810 | Y2 | | 2/1986 |
| JP | 61-287571 | | | 12/1986 |
| JP | 2-282074 | | | 11/1990 |
| JP | 8-305291 | | * | 11/1996 |
| JP | 8-337274 | | | 12/1996 |
| JP | 8-337274 | A | | 12/1996 |
| JP | 10-278970 | | * | 10/1998 |
| JP | 11-208722 | | | 8/1999 |

OTHER PUBLICATIONS

International Search Report of PCT/JP99/05309.
Supplementary European Search Report of EP 99 96 9701.
English Translation of International Preliminary Examination Report of PCT/JP99/05309.
Supplementary Partial European Search Report of Application No. EP 99 95 9709 dated Apr. 16, 2002 (Searched in Munich).
Supplementary European Search Report of Application No. EP 99 95 9709 dated Oct. 24, 2002 (Searched in Munich).
Official English translation of the International Preliminary Examination Report of The International Bureau of WIPO for PCT/JP99/06890.

* cited by examiner

FIG. 1(A)
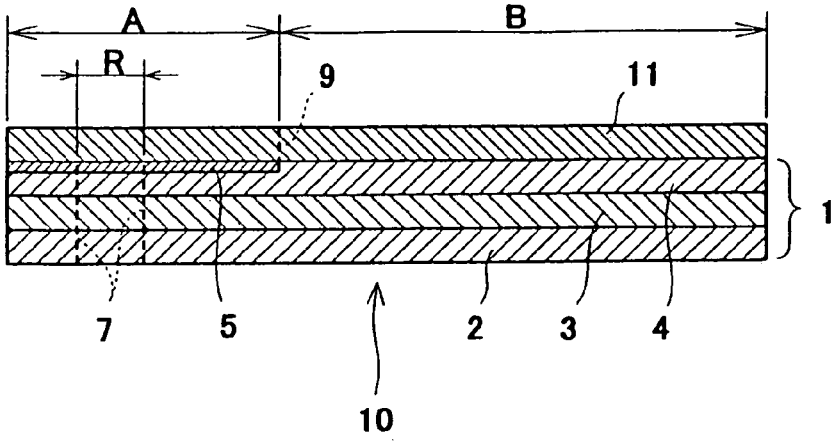
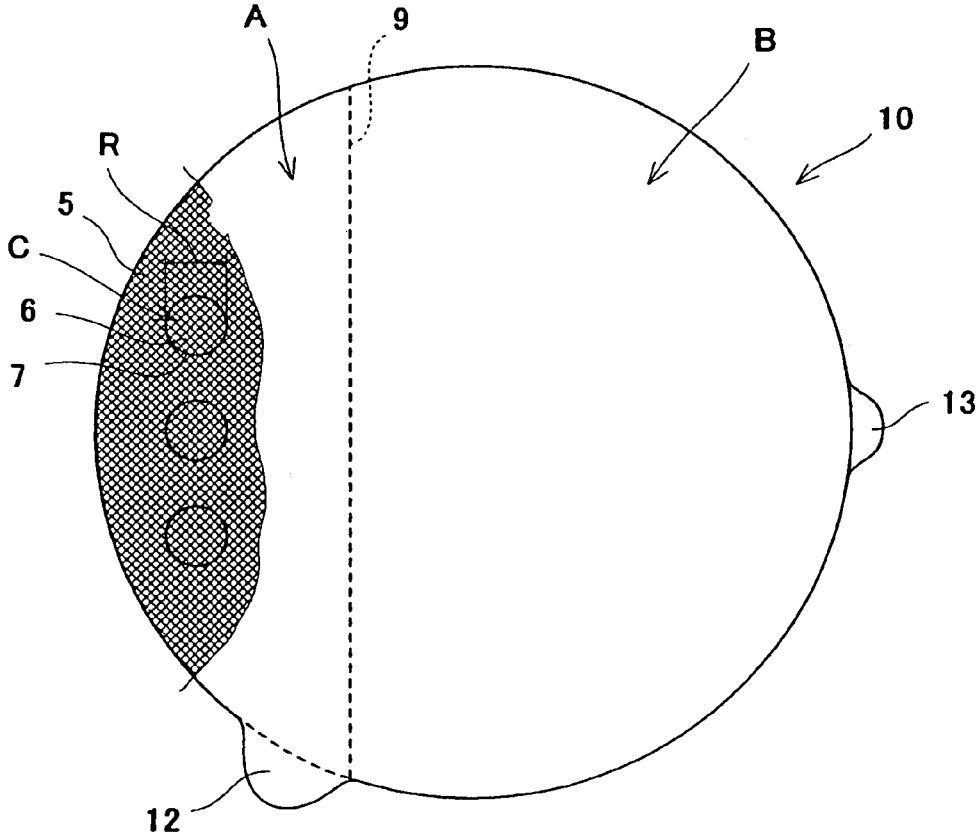
FIG. 1(B)

FIG. 3(A)
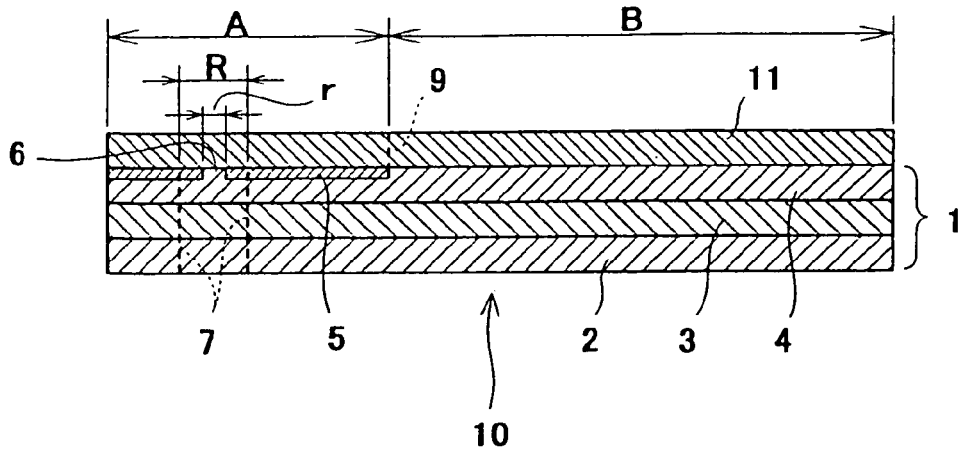
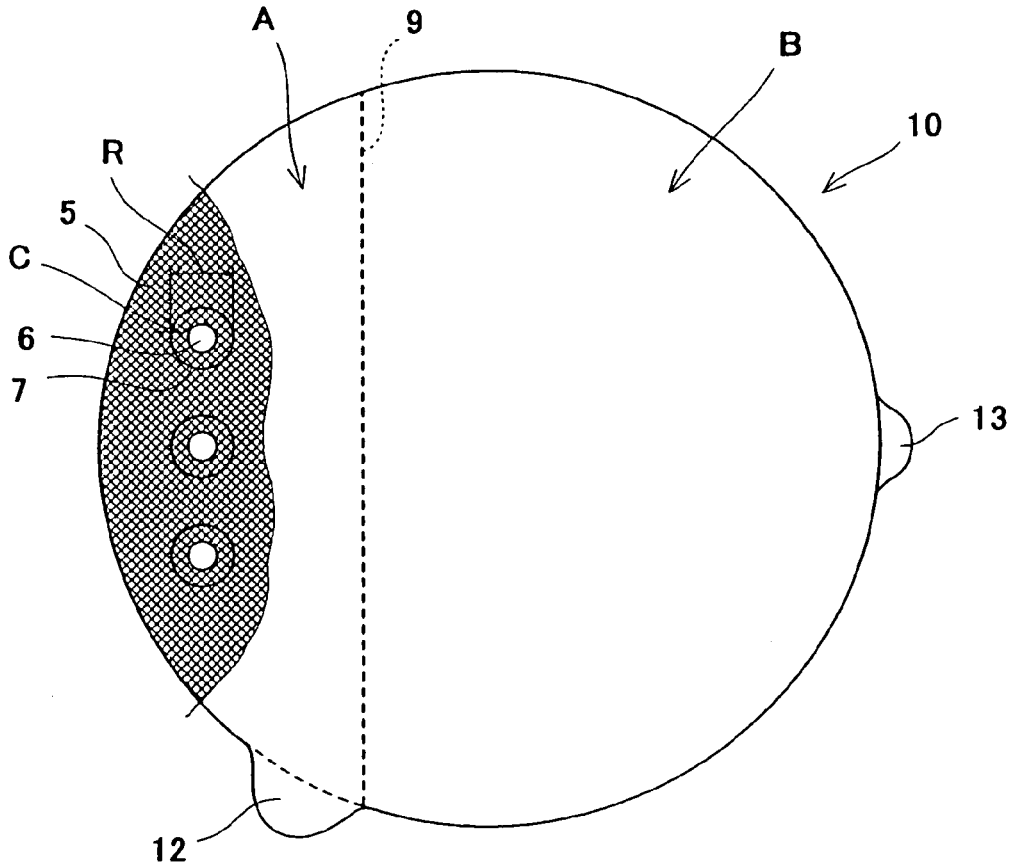
FIG. 3(B)

FIG. 5(A)
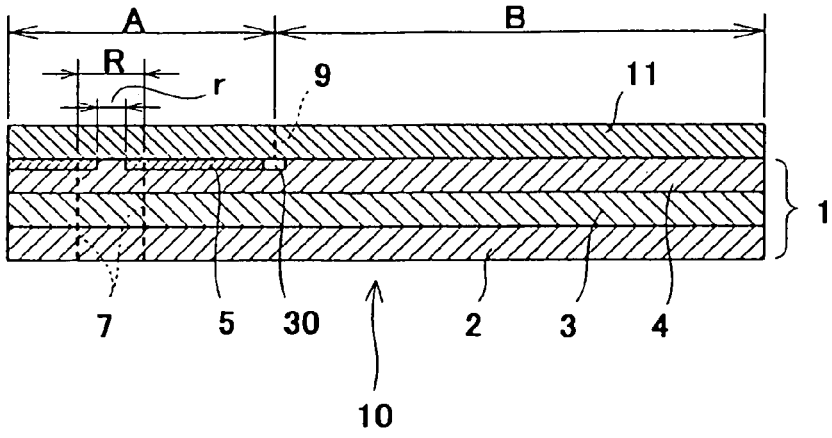
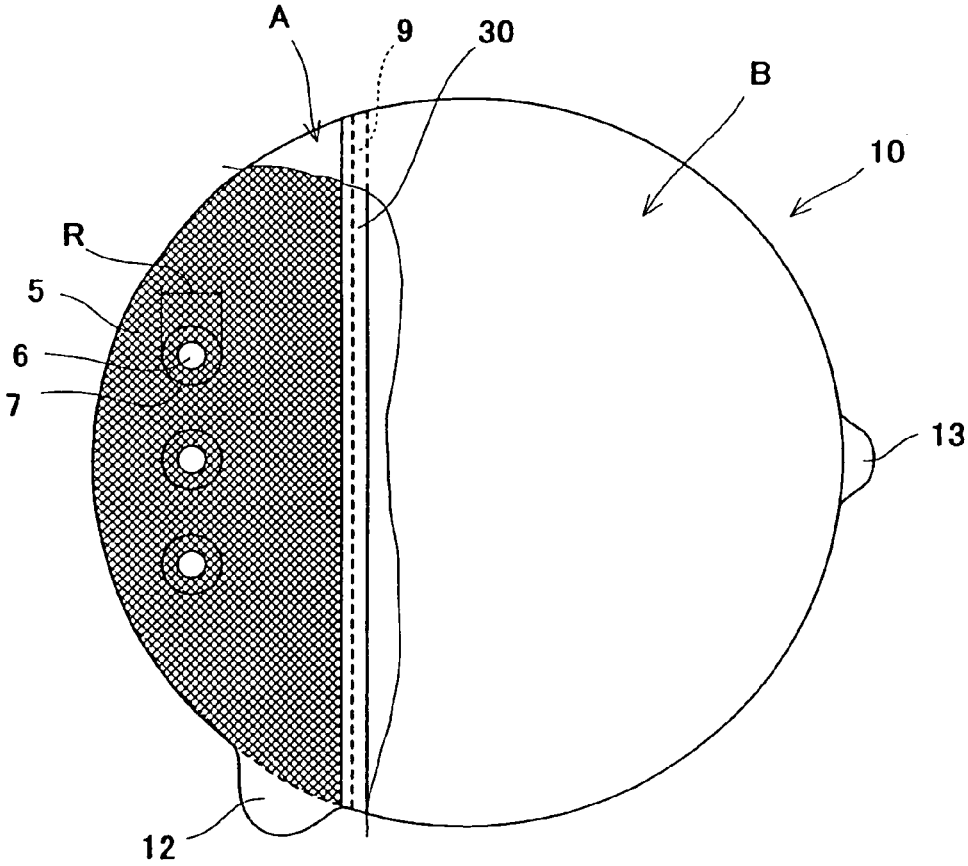
FIG. 5(B)

FIG. 6(A)
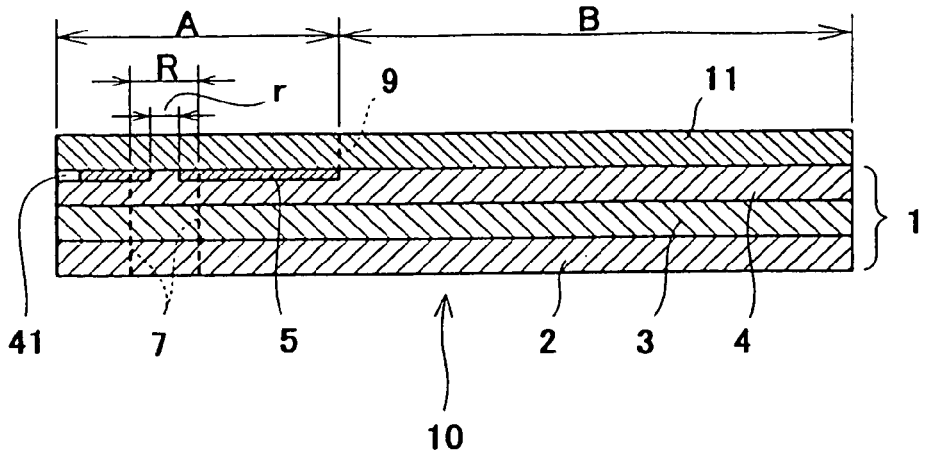
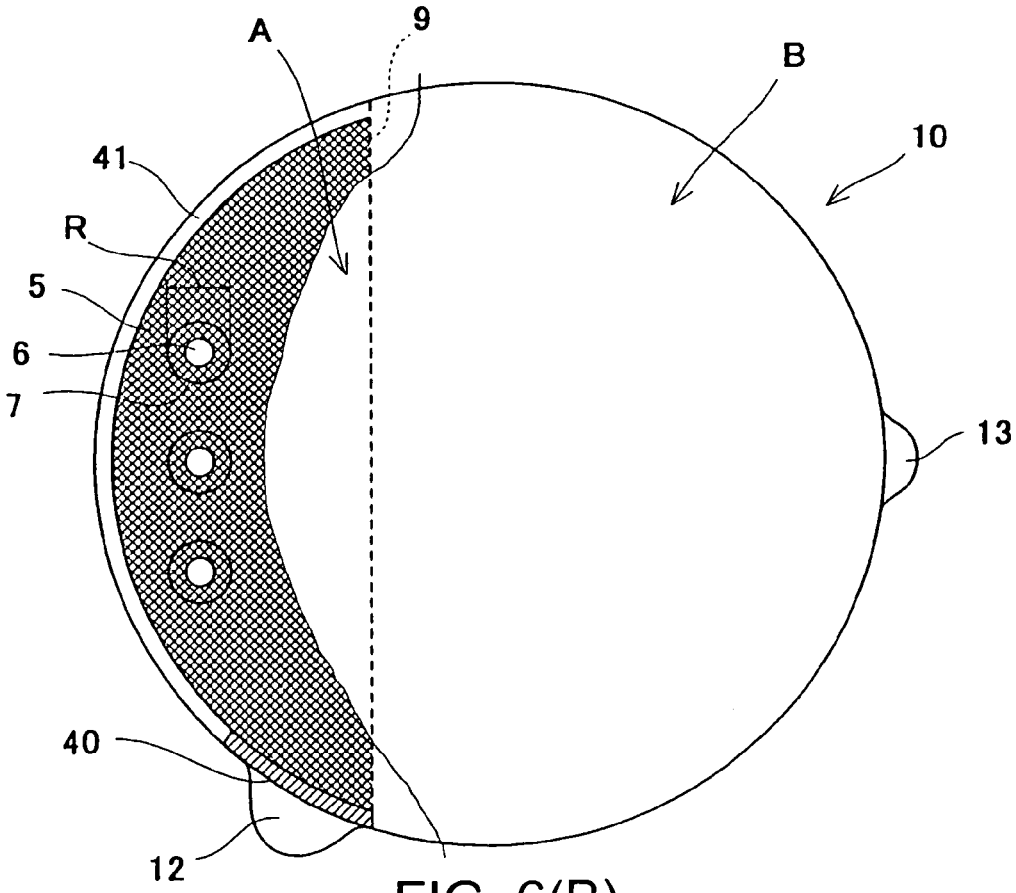
FIG. 6(B)

FIG. 7(A)
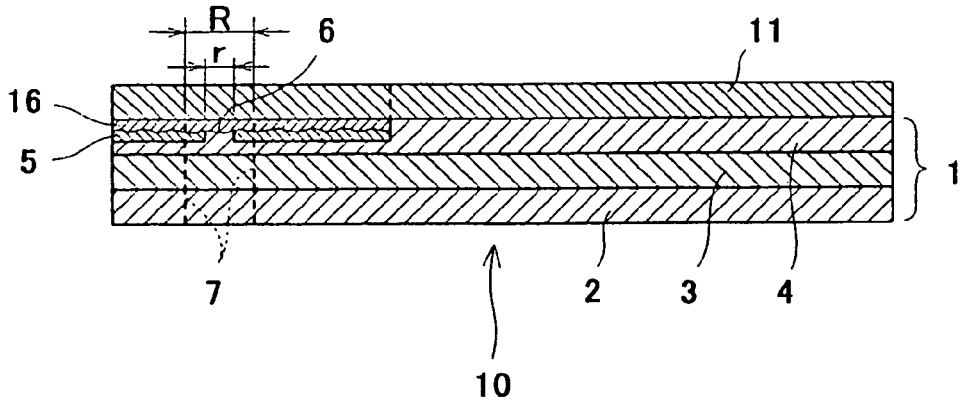
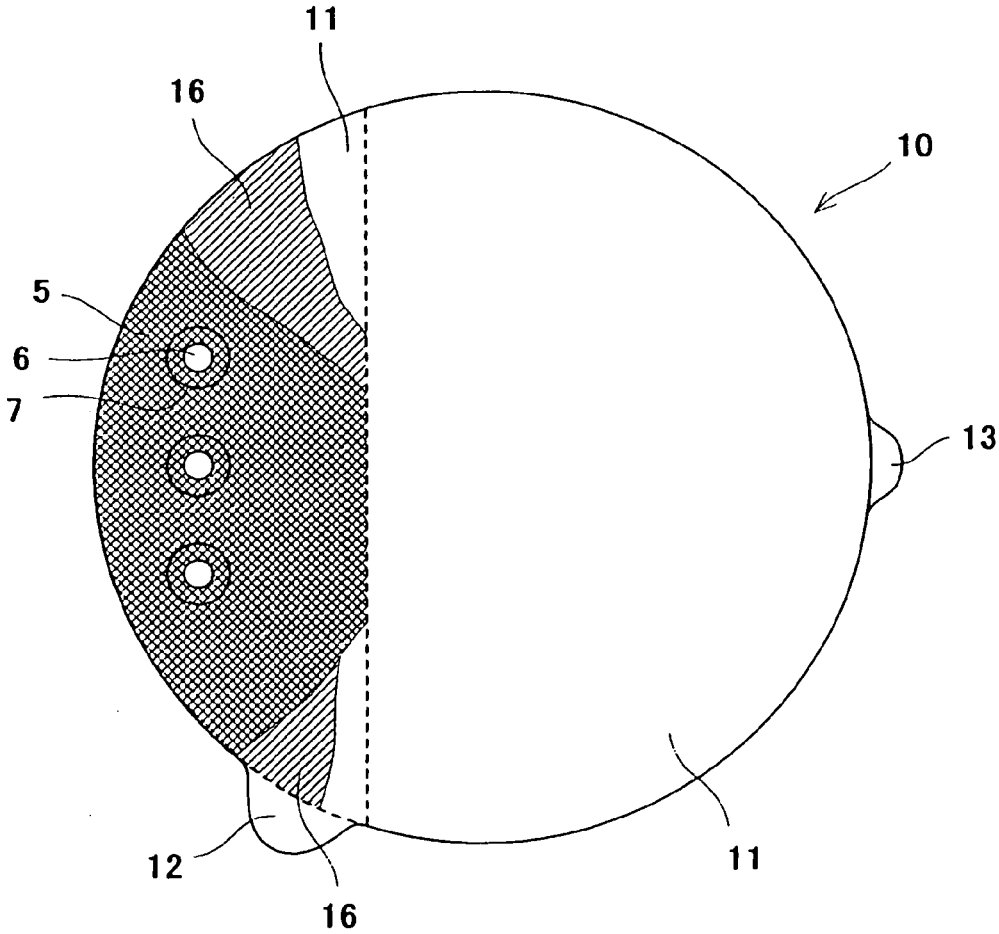
FIG. 7(B)

FIG. 9(A)
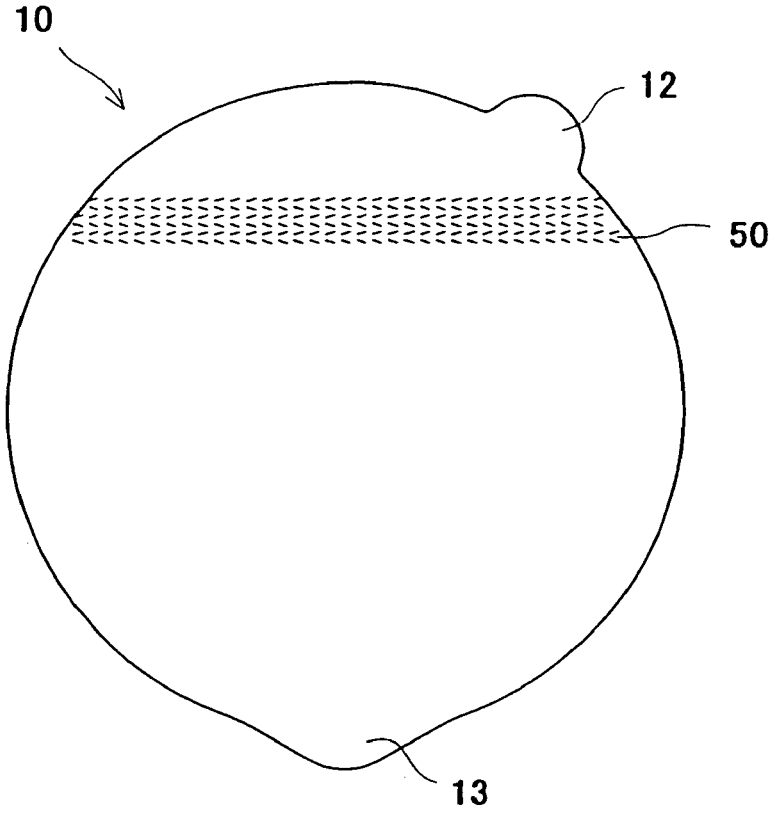
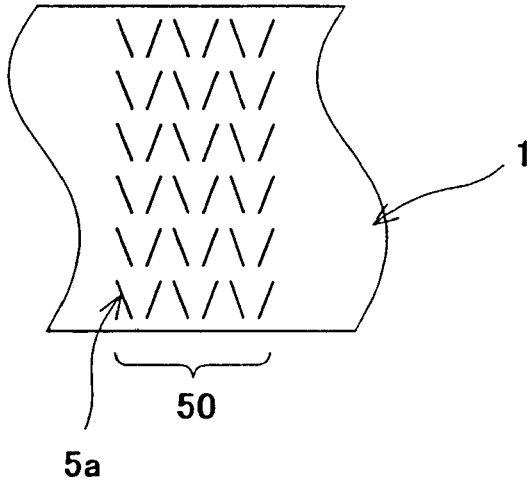
FIG. 9(B)

FIG. 12(A)
(PRIOR ART)
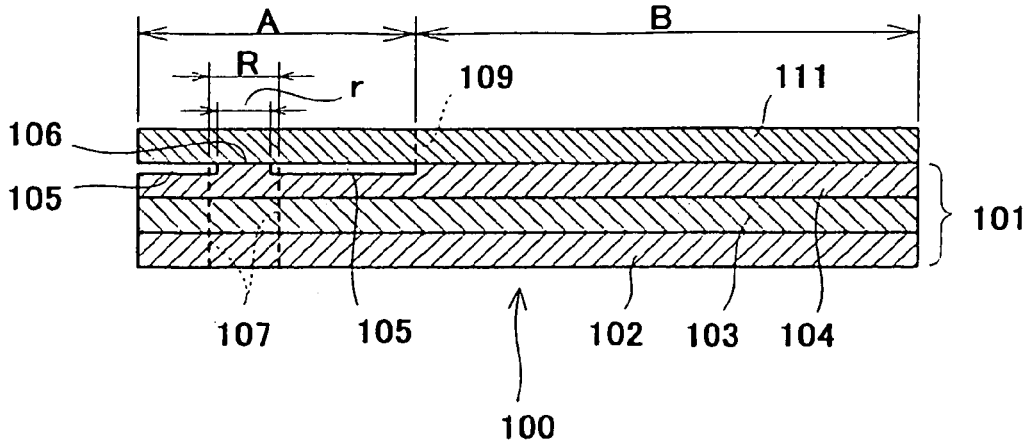
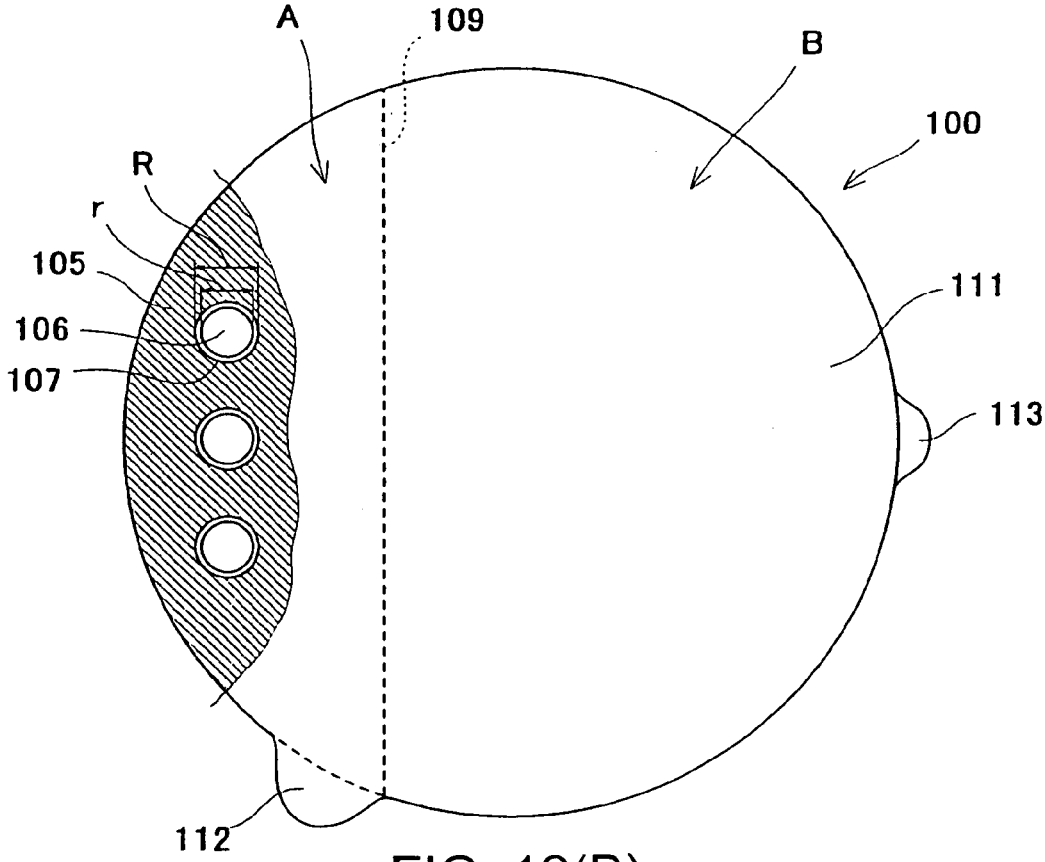
FIG. 12(B)
(PRIOR ART)

LID MEMBER FOR FOOD CONTAINER

TECHNICAL FIELD

The present invention relates to an improved lid member for a food container, more particularly, to a lid member having a laminated structure, to be used as containers for quickly cookable foods.

BACKGROUND ART

Conventionally, quickly cookable foods like chow mein, spaghetti, polished rice and sekihan (steamed rice with red beans) or the like have been distributed as a sort of quickly cookable foods to be cooked by pouring thereinto hot water, leaving it for a predetermined time and removing therefrom the hot water.

As the containers for quickly cookable foods, as illustrated in FIG. 12(A), the present Applicant had proposed a sheet-form lid member 100 having the layered structure in which the surface sheet 111 is laminated onto the composite sheet 101. With reference to FIG. 12(B), this lid member 100 is a circular lid member when it is viewed horizontally, then the surface thereof is sectioned into the easily-peelable area A and the non-peelable area B having the aforementioned layered structure. Further, the easily-peelable area A has the easily-peelable layer 105 formed by applying lubricant (smooth releaser; e.g., release varnish) between the surface sheet 111 and the composite sheet 101.

Circular slits 107 of inner diameter R for apertures are entered vertical-sectionally into the easily-peelable area A in the composite sheet 101, and a bond area 106 (where the easily-peelable layer 105 is not formed) of the inner diameter r is formed in the back of the surface sheet 111 to be contacted with cut area made on the composite sheet 101 by the slit 107. Since the composite sheet 101 is adhered to the surface sheet 111 through contact area 106, when the surface sheet 111 is peeled from the composite sheet 101, the slit 107 is simultaneously broken, thereby, apertures are formed in the composite sheet 101. Then, as illustrated in FIG. 13, a container for the instantly cookable foods are made by adhering (e.g., heat-sealing) the lid member 100 onto the flange 121 of the container 120 for the instantly cookable foods, and hermetically packing the container.

Hermetically packed container 120 is opened, for example, by pulling up tab 113 integrally made of the composite sheet 101 at the outer circumference of the non-peelable area B, and peeling a part of the lid member from the flange 121. Then, after pouring the hot-water into the container 120, the tab 113 is again bent over toward the flange 121 to reseal the container 120. After then, it is left for several minutes to cook the instantly-cookable foods (not shown) in the container.

Then, apertures are formed in the composite sheet 101 by pulling up tab 112 integrally made of the surface sheet 111 at the outer circumference of the lid member 100, and peeling the easily-peelable area A in the surface sheet 111 from the composite sheet 101. Thereafter, unnecessary hot water in the container 120 is discharged from such apertures.

Slits 107 of inner diameter R are made to include whole of the contact area 106 of inner diameter r and a part of the easily-peelable layer 105. But, due to peeling of the easily-peelable layer 105, the surface sheet 111 is unpredictably peeled along the outline of the contact area 106 when it receives pressure or impact by the molded blades.

Since such diameters R and r are typically approximate values, precise registration is necessary to register the mutual positions of the areas cut by the slit 107 and the easily-peelable layer 105. Actually, in such cases, considerable skilled techniques are needed to apply lubricant minutely and to register the layers precisely, and production loss on the lid member would not be avoided.

Then, when the surface sheet 111 in the easily-peelable area A is going to be peeled from the composite sheet 101, the surface sheet 111 is not peeled straightly along the slit 109 formed previously, and the surface sheet is torn (picked), figure of the lid member 100 therefore became unfavorable.

Such matters happen when the peel strength between the surface sheet 111 in the easily-peelable area A and the composite sheet 101 is large, or when mutual position therebetween is not registered well.

As a conventional lubricant, it may include and use a thermo-plastic resin such as a urethane resin, polyamide resin or the like, nitrocellulose resin, or the lubricant (the release varnish) containing a combination of these resins as a main ingredient. But, according to these lubricants, in the production of the lid member 100, lubricant width has to be restricted to the narrower width of 20 through 40 g/15 mm in view of peelability (peel strength) of the surface sheet 111. As a result thereof, continuous production of the lid member would be difficult, in addition thereto, peelability of the surface sheet 111 is poor and the surface sheet 111 cannot be peeled smoothly at the peeling thereof.

Conventional lid member as illustrated in FIG. 12 may therefore not have enough peelability on the surface sheet 111 in the easily-peelable area A, in particular, inconvenient picking might not be avoided in the paper surface sheet 111.

The present invention is aimed to relax such duties for applying the lubricants aforenoted as well as necessary work to register the mutual position between the composite sheet 101 and the surface sheet 111, while qualities on the lid member is improved by preventing unpredictable peeling, with the easily-peelable layer 105, of the surface sheet 111 along the outline of the contact area 106.

The present invention is aimed to realize the lid member which can smoothly peel the surface sheet from the composite sheet and can easily expose/form the apertures without picking the paper surface sheet 111.

SUMMARY OF THE INVENTION

With reference to FIG. 1, a lid member for food container (hereinafter simply referred to as "lid member") according to the present invention comprises:

an easily-peelable area A comprising additionally an easily-peelable layer 5 formed by applying lubricant between the surface sheet 11 and the composite sheet 1, an opening area C placed within the easily-peelable area A and to form apertures therein, and a non-peelable area B placed adjacent to the easily-peelable area A;

a first slit 7 which cut the composite sheet 1 vertical-sectionally and form the apertures in the opening area C, and a second slit 9 (to peel the surface sheet in the easily-peelable area A) which cut the surface sheet 11 vertical-sectionally and is laid along the boundary line between the easily-peelable area A and the non-peelable area B; and the lid member is further characterized in that the surface sheet 11 is adhered to the composite sheet 1 at the opening area C without the lubricant through an area (not shown) which is smaller than cut area which form apertures made within the composite sheet 1 with the first slit 7.

The easily-peelable area A is an area in which the surface sheet 11 can easily be peeled with lubricant from the composite sheet 1. Then, the opening area C is an area within the easily-peelable area A to form apertures by peeling from the composite sheet the surface sheet 111 together with a part of the composite sheets which are adhered thereto and are filling the apertures. With regard to the non-peelable area B, since there is no lubricant between the composite sheet 1 and the surface sheet 11, it is an area wherein the surface sheet 11 cannot be peelable easily from the composite sheet 1.

According to the lid member of the present invention, the surface sheet 11 in the easily-peelable area A can be easily and securely peeled along the second slit 9 and, by peeling the surface sheet 11 in the easily-peelable area A, apertures can easily be formed in the opening area C along the first slit 7. The area of adherence between the surface sheet 11 and the composite sheet 1 at the opening area C is ranged from about 1/9 to about 4/9 of the cut area formed by said first slit 7 (not shown) to smoothly adjust the mutual position between the first slit 7 and contact area in the apertures and to avoid an exfoliation into the container of the surface sheet just above the apertures.

As an preferable embodiment for the lid member 10 of the present invention, with reference to FIG. 3, relation between circular cut area of inner diameter R formed by the first slit 7 and circular cut area of inner diameter r appeared in the back of the surface sheet 11 are preferably designed to be from $R/3 \leqq r \leqq 2R/3$. This is equivalent to, in area ratio, from about 1/9 to about 4/9 of the cut area formed by said first slit 7.

Then, according to a preferable embodiment of the lid member 10 of the present invention, the easily-peelable layer 5 in the easily-peelable area A is formed by applying the lubricant in the form of a pattern. Such patterns may include a dot-pattern, a mesh-pattern, a check-pattern, a diffusion-pattern, and combination of such patterns, and any of these can be employed in the present invention.

Of these patterns formed by the lubricant, an embodiment of dot-pattern formed by applying the lubricant circularly and regularly as shown in FIG. 4(A) and that of mesh-pattern formed by applying the lubricant to remain circular blanks regularly as shown in FIG. 4(B) are preferable to the present invention. When the pattern is formed according to any of such embodiments, it is preferable to occupy with the lubricant from about 60% to about 90% of the easily-peelable area.

By employing a method for applying the lubricant in the form of such patterns, it is no longer necessary to prepare in the opening area C a contact area for the apertures within the first slit 7 only. Then, by applying the lubricant in the form of such patterns, when the circular slit 7 is entered vertical-sectionally into the composite sheet 1, an unpredictable irregular peeling (including misregistration) due to pressure or impact by the molded blades (clicking blades) between the composite sheet 1 and the surface sheet 11 can be avoided.

Further, according to the other embodiment of the present invention, with reference to FIG. 5, in an easily-peelable layer 30, the lubricant is applied in solid form along the second slit 9 formed along the boundary line between the easily-peelable area A and the non-peelable area B. Thereby, peel strength of the surface sheet 11 to the composite sheet 1 is reduced at the second slit 9, therefore, the surface sheet 11 can easily be peeled in the easily-peelable area A. Then, as also illustrated in FIG. 5, since the easily-peelable layer 30 can have some width, mutual position between the composite sheet 1 and the surface sheet 11 can easily be determined at their lamination step by using the wider easily-peelable layer as a hallmark.

According to the further embodiment of the present invention, with reference to FIG. 6, a tab 12 to peel the surface sheet 111 for the apertures is mounted at the circumference edge of the easily-peelable area A in the lid member, then, an easily-peelable layer 40 is formed by applying the lubricant around the circumference edge (foot-ends of the tab) adjacent to the tab 12 on the easily-peelable area A. Thereby, necessary strength to peel the surface sheet 11 is reduced, therefore, the surface sheet 11 can easily be peeled in the easily-peelable area A. When an easily-peelable layer 41 around the circumferencial edge, except at adjacent to the tab 12, is formed by applying thereto the lubricant in the form of dot-pattern or mesh-pattern, lifting of the surface sheet 11 can be relaxed at the heat-sealing of the lid member 10 onto the container. With regard to this case, for a method of applying the lubricant to the easily-peelable layer 41 around the circumference edge in the easily-peelable area A, it is preferable to reduce the lubricant density to less than that at the easily-peelable layer 5 in the non-circumference area.

Further, according to the other embodiment of the present invention, the lubricant to form the easily-peelable layer 5 comprises wax in the amount of from about 5 wt % to about 95 wt % thereof. By incorporating the predetermined amount of wax into the lubricant, when hot water is poured into the food container and the lid member is heated therewith, the surface sheet 11 in the easily-peelable area A can easily be peeled from the composite sheet 1, because the wax components are bled, thereby, adhesion between the surface sheet and the composite sheet in the easily-peelable area A are reduced.

According to the further embodiment of the present invention, with reference to FIG. 7, the lid member 10 further comprises varnish layer (filling varnish layer) 16 between the easily-peelable layer 17 and the surface sheet 11. By applying the varnish layer 16 onto the surface sheet 11, time-coursely transfer and absorption of the releasant or the wax in the easily-peelable layer 17 into the surface sheet 11 can effectively be prevented, thereby, reasonable release characteristics are kept and the peeling of the surface come to be easy.

Then, according to the other embodiment of the present invention, with reference to FIG. 8, a notch 15 is further entered from the circumference edge of the lid member 10 to the second slit 9 or in adjacent thereto. The notch cuts and penetrates from the surface sheet 11 to the composite sheet 1, thereby, the surface sheet 11 in the easily-peelable area A can easily be peeled from the composite sheet 1 with the notch 15 as a trigger. In particular, when the tab 12 for the apertures is placed adjacent to the second slit 9, since the notch 15 and the second slit 9 are successively and smoothly broken by pulling up the tab 12, tear of the tab as well as picking of the surface sheet around the second slit 9 can be prevented.

Further, according to the other embodiment of the present invention, with reference to FIG. 9(A), besides the second slit 9 made as a continuous linear slit, the lid member can employ that prepared as a slit zone in which a pair of discontinuous slits 5*a* inclinates mutually outwardly.

BRIEF DESCRIPTION OF THE DRAWINGS

FIGS. 1(A) and (B), respectively, show a longitudinal sectional view and a partially cutaway plan view of the lid member according to an embodiment of the present invention.

FIGS. 3(A) and (B), respectively, show a longitudinal sectional view and a plan view of the lid member according to another embodiment of the present invention.

FIG. 4(A) is a partially enlarged schematic view showing the lubricant applied in the form of dot-pattern, while

FIGS. 5(A) and (B), respectively, show a longitudinal sectional view and a partially cutaway plan view of the lid member according to another embodiment of the present invention.

FIGS. 6(A) and (B), respectively, show a longitudinal sectional view and a partially cutaway plan view of the lid member according to another embodiment of the present invention.

FIGS. 7(A) and (B), respectively, show a longitudinal sectional view and a partially cutaway plan view of the lid member according to another embodiment of the present invention.

FIGS. 9(A) and (B), respectively, show a plan view of the lid member and a partially enlarged view of the lid member according to another embodiment of the present invention.

FIGS. 12 and 13 are views of a food container sealed with the conventional lid member.

DETAILED DESCRIPTION OF THE PREFERRED EMBODIMENTS

Figure 2:
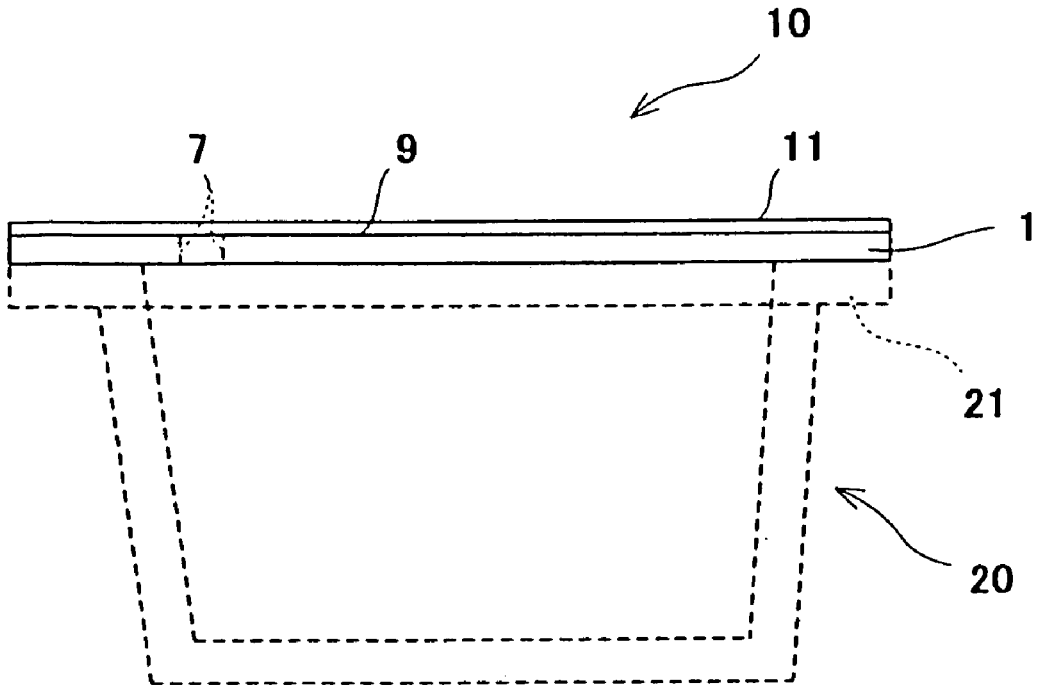
FIG. 2 shows front sectional view of a food container sealed with the lid member according to an embodiment of the present invention.

Detail of the present invention will be described as follows.

With reference to FIGS. 1(A) and (B), in general, a lid member of the present invention is the lid member 10 having the layered structure in which the surface sheet 11 is laminated onto the circular or polygonal composite sheet 1. Then, the lid member 10 is sectioned into the easily-peelable area A comprising additionally easily-peelable layer 5 formed by applying lubricant between the surface sheet 11 and the composite sheet 1, an opening area C placed within the easily-peelable area A and to form apertures therein, and a non-peelable area B placed adjacent to the easily-peelable area A.

Opening area C has a first slit 7 which cut the composite sheet 1 vertical-sectionally and form the apertures.

First slit 7 is entered with molded blades (clicking blades) onto back side (side where the surface sheet 11 is not laminated) of the composite sheet 1, then, when the surface sheet in the easily-peelable area A is peeled, a part of the composite sheets sectioned with the circular first slit 7 are removed together with the surface sheet 11 adhered therewith.

Then, the second slit 9 to separate the surface sheet 11 from the composite sheet 1 is entered vertical-sectionally onto the surface sheet 11 in the easily-peelable area A substantially along the boundary line between the easily-peelable area A and the non-peelable area B or on the boundary line between area A and B (see, FIG. 1(B)). Second slit 9 may be any form selected from continuous linear slits, discontinuous slits like perforated slits, or slit zone in which a pair of discontinuous slits inclinating mutually outwardly makes plural rows.

Further, the surface sheet 11 is adhered to the composite sheet 1 at the opening area C without the lubricant through an area (not shown in FIG. 1) which is smaller than the cut area which forms apertures in the composite sheet 1 with the first slit 7. As an adhesion area, any area which is smaller than the cut area by the first slit 7 is applicable, and it may include circular cut area of inner diameter r as shown in FIG. 3(A), or area formed in the form of a pattern like a dot-pattern or, beside the combination of such area, crosswise form or the like.

Then, the tab 12 is projectively mounted at the circumference edge of the easily-peelable area A. Tab 12 is made of the surface sheet 11 and, by pulling it up, the surface sheet 11 is peeled from the composite sheet 1. But, it is not necessary to make the tab with the surface sheet 11 only, then, it may either be a separate tab adhered onto the surface sheet 11 with strong adhesion or a laminated tab which has a slit penetrating the composite sheet 1 at foot-ends thereof and the layered structure of the composite sheet 1 and the surface sheet 11.

Further, the tab 13 is projectively mounted at the circumference edge of the non-peelable area B. Tab 13 is made of the composite sheet 1 and, by pulling it up, the lid member 10 is peeled from the flange of a container, thereby, the container is opened. Tab 13 may also either be a tab comprising, for example, both the surface sheet 11 and the composite sheet 1 or a separate tab adhered onto the composite sheet 1 with strong adhesion.

Although it is preferable to employ the tabs 12 and 13, such tabs are not always necessary if each of the surface sheet 11, the composite sheet 1 or the lid member 10 can be peeled without any tab.

Aforenoted lid member can be peeled, in the easily-peelable area A, the surface sheet 11 from the composite sheet 1, thereby, apertures are made in the opening area C, simultaneously, the surface sheet 11 in the easily-peelable area A can be separated along the second slit 9.

Then, as illustrated in FIG. 2, containers for quickly cookable foods are made by sealing (e.g., heat-sealing) the lid member 10 of the present invention onto the flange 21 of a container 20 (plastic container or paper container) and hermetically packing the container 20.

Then, according to the other embodiment of the present invention, with reference to FIGS. 3(A) and (B), cut area of inner diameter R formed in the composite sheet 1 by the first slit 7 entered vertical-sectionally into the composite sheet 1 is adhered (faced) to a contact area 6 (where the easily-peelable layer is not formed) of inner diameter r of 2R/3 or less formed in the back of the surface sheet 11. Thus, the contact area 6 is surrounded with the cut area of inner diameter R. If the inner diameter r is 2R/3 or more, registration on the mutual position between the cut area of inner diameter R with the contact area 6 would be difficult. Thus, in general, the inner diameter r is determined by depending on the inner diameter R, but it should be adjusted preferably to about 2R/3 or less (about ⅔ or less as area), more preferably, to from about R/3 to about 2R/3 (about ⅓ to about 4/9 as area). Such relation is similarly applied to the first slit 7 for square or elliptical apertures, in such cases, size of contact area is ranged from about 1/9 to about 4/9 of the cut area by the first slit 7.

By forming the contact area 6 like that, registration of the contact area to the apertures would be smooth, and exfoliation of the composite sheet at the apertures into the container can effectively be prevented.

Effects to be offered by such contact area 6 are their advantages, in either case, where the lubricant is solidly applied to the whole of the easily-peelable area or the lubricant is applied to the easily-peelable area A in the form of a pattern as described below.

Inner diameter R of the circular area for the apertures formed by the first slit 7 can be any size as long as it allows smooth discharge of the hot water and may not be blocked by the cooked foods, and it may be adjusted to, for example, in the circular apertures about 5 mm≦R≦ about 7 mm, preferably about 5.5 mm≦R≦ about 6.5 mm. In such case, if the contact area 6 is also formed circularly, preferably, their inner diameter r is designed to the range of about 2.0 mm≦r≦ about 4.3 mm. As a matter of course, number of the apertures to be formed in the easily-peelable area A can be changed optionally according to an amount and kinds of the foods to be put into the container.

As an embodiment to apply the lubricant, besides an embodiment to solidly apply it to form a continuous layer over the whole area of the easily-peelable area A, it can be applied to the entire area A in the form of a pattern. For example, in addition to a dot-pattern or a mesh-pattern as shown in FIG. 4, a check-pattern, a diffusion-pattern and a combination of such patterns can be employed in the present invention.

Figure 4A:
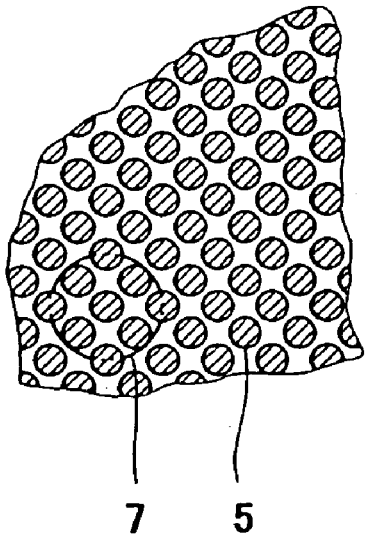
Figure 4B:
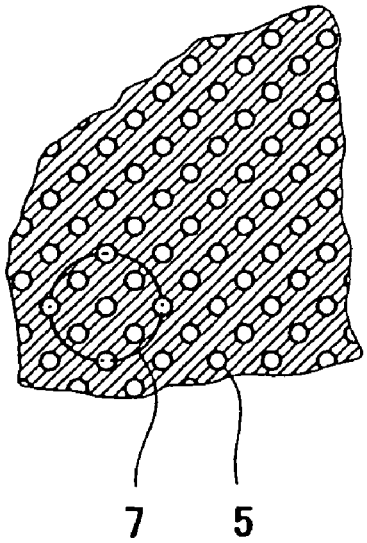
FIG. 4(B) is a partially enlarged schematic view showing the lubricant applied in the form of mesh-pattern.

In particular, a dot-pattern as illustrated in FIG. 4(A) and a mesh-pattern as illustrated in FIG. 4(B) formed respectively by applying the lubricant in the form of the aforenoted pattern (shaded portion in FIGS. 4(A) and (B) is a portion applied by the lubricant) are preferable for the present invention.

In such embodiments, the lubricant is applied to the easily-peelable area A including the opening area C in the condition of, for example, from about 0.5 mm to about 1.5 mm of dot diameter and from about 0.5 to about 2.0 lines/mm of dot lines for the dot-pattern, and from about 0.3 mm to about 0.5 mm of mesh size and from about 0.5 to about 2.0 lines/mm of mesh lines for the mesh pattern. In this case, an area to be applied with the lubricant in the easily-peelable layer 5 is adjusted so that about 60% to about 90% of the easily-peelable area A is occupied thereby.

Generally, when the slit 7 for the apertures is entered with the molded blade into the composite sheet 1 and the easily-peelable layer 5, it is necessary to confer an adequate peelability to the easily-peelable layer 5 to avoid an unpredictable irregular exfoliation along outline of the slit 7 due to pressure or impact by the molded blades. In the other words, the easily-peelable layer 5 must have the adequate peelability and an adequate adhesion not to bring the unpredictable irregular exfoliation. In order to get such adequate peelability, it is preferable that the lubricant is applied in the form of a pattern including a dot-pattern, a mesh-pattern, a check-pattern, a diffusion-pattern, and register an area to be applied with the lubricant to the area aforenoted. By applying the lubricant in the form of a pattern, in about 10% through about 40% of the aperture area, the composite sheet is adhered to the surface sheet in the area without the lubricant. Accordingly, unless adherence of surface sheet 11 to the composite sheet 1 (mileage) is achieved in the opening area C, the composite sheet in the apertures would not be exfoliated into the container due to insufficient adhesion. But, even when the lubricant is applied to the easily-peelable area A in the form of a pattern, besides pattern application onto the whole of area A, it is also preferable to add mileage around the outline of the apertures to enhance an adhesion therearound between the surface sheet and the composite sheet.

Then, according to the other embodiment of the present invention, with reference to FIGS. 5(A) and (B), in a lid member wherein the lubricant is applied to the easily-peelable area A in the form of a pattern, the easily-peelable layer 30 along the second slit 9, which is the boundary line between the easily-peelable area A and the non-peelable area B, is formed by solidly applying thereto the lubricant.

Since the peel strength of the surface sheet 11 to the composite sheet 1 is reduced at the second slit 9 by this easily-peelable layer 30, the surface sheet 11 in the easily-peelable area A can be easily separated at the second slit 9. Then, when the easily-peelable layer 30 has particular width, by employing such wide easily-peelable layer 30 as a hallmark, mutual position between the composite sheet 1 and the surface sheet 11 can easily be determined at their lamination step, then accurate registration of the second slit 9 can also easily be performed.

Then, according to the other embodiment of the present invention, with reference to the FIGS. 6(A) and (B), in order to reduce the peel strength of the surface sheet 11 at the opening of the lid member 10 in which the lubricant in the easily-peelable area A is applied in the form of pattern, the easily-peelable layer 40 is formed by solidly applying the lubricant between the composite sheet 1 and the surface sheet 11 at the outer circumference in the easily-peelable area A and adjacent to the tab 12.

At the outer circumference 41 in the easily-peelable area A except adjacent to the tab 12, in order to confer to the lid member 10 the peel strength of not peeling the surface sheet 11, the easily-peelable layer 41 is formed by applying the lubricant between the composite sheet 1 and the surface sheet 11 in the form of a dot-pattern having a diameter of about 0.5 mm to about 2 mm, or a mesh-pattern having a mesh space of about 0.5 mm to about 3 mm. This is due to the lesser peel strength of the lid member heat-sealed to the container when the mesh space of the mesh-pattern is smaller than about 0.5 mm, thereby, the surface sheet 11 tends to be peeled, while the peel strength would be too strong when the mesh space of the mesh-pattern is larger than about 2 mm. Similarly, in the case of a dot-pattern, the peel strength of the lid member heat-sealed to the container would be reduced when the diameter of the dot-pattern is larger than about 3 mm, thereby, the surface sheet tends to be peeled, while the peel strength would be too strong when the diameter of the dot-pattern is smaller than about 0.5 mm. In such case, applied area (density) of the lubricant at the outer circumference 41 is substantially identical to or smaller than that of the easily-peelable layer 5 except for the outer circumference, therefore, adhesion in the outer circumference 41 is substantially identical to or larger than that of the easily-peelable layer 5 except for the outer circumference.

According to an experiment performed by the present inventors, when mesh-space of the mesh pattern in the easily-peelable layer was adjusted to about 0.3 mm, the peel strength was reduced from about 40 to about 50 g/15 mm width to from about 25 to about 30 g/15 mm width by heat-sealing it onto the lid-member in the temperature of from about 160 to about 190° C., then the surface sheet could easily be peeled. But, when mesh-space of the mesh pattern in the easily-peelable layer was adjusted about 0.5 mm, the peel strength was from about 50 to about 70 g/15 mm width, then it was unchanged after the heat-sealing, and any inconvenience including the lifting of the surface sheet could not be seen.

With regard to the lid member 10 according to each of the embodiments of the present invention described previously, it is preferable to incorporate wax into the lubricant to form the easily-peelable layer 5 in the easily-peelable area A in the amount of from about 5 wt % to about 95 wt % thereof. Lubricants to be used for peeling the surface sheet from the laminated sheet include typically nitrocellulose resin, urethane resin or polyamide resin, or release varnish containing a combination of such resins as a main ingredient. But such lubricants were hard to keep an adequate releasability and to separate both sheets smoothly. Thus, when waxes are mixed and wax contents in the lubricant are adjusted to from about 5 wt % to about 95 wt % of the lubricant, wax components are bled by pouring hot water into the container to cook the foods therein, then the peel strength between the composite sheet 1 and the surface sheet 11 is reduced, thereby their releasabilities can be improved. Suitable waxes having such properties may include polyethylene wax, polyester wax, aliphatic amide wax and combination thereof.

When lubricant containing the wax is used, a suitable application form of the lubricant in the easily-peelable layer 5 may also include applying it in the form of a pattern, as shown in FIGS. 4–6, besides a form to solidly apply the lubricant to the entire easily-peelable layer 5. Even in such cases, aforenoted wax contents may also be applicable.

Then, according to another embodiment of the present invention, with reference to FIGS. 7(A) and (B), in the series of the lid members 10 described previously, each of which is made as the lid member 10 having the layered structure of the composite sheet 1, the easily-peelable layer 5, varnish layer 16, and the surface sheet 11 wherein varnish layer (filling varnish layer) 16 is applied onto the back of the surface sheet 11 in the easily-peelable area A.

By additionally applying the varnish layer 16 onto the back of the surface sheet 11, the surface sheet 11 can easily be peeled without tear thereof from the composite sheet 1. This means that the applied varnish layer 16 solves the problem between the lubricant and the surface sheet of, for example, less releasabilities due to time-coursely absorption of the lubricant into the surface sheet.

Term "adequate releasability" used for the easily-peelable layer 5 wherein the varnish layer is applied thereto is directed to an adhesion of from about 10 to about 20 g/15 mm according to the peelability test. If the adhesion is less than about 10 g/15 mm, spontaneous peeling may be brought due to interlayer peeling in the easily-peelable layer 5, while when the adhesion is larger than about 20 g/15 mm, such adhesion would be too strong. Preferable varnish layers to be applied to adjust the adhesion may include mix varnish containing nitrocellulose resin, urethane resin, aminoalkyd resin, polyamide resin or the like. When the varnish layer 16 is employed, preferably, the lubricant to form the easily-peelable layer 5 to be contacted with the varnish layer 16 contains wax in the amount of from about 20 wt % to about 85 wt % thereof.

Figure 8:
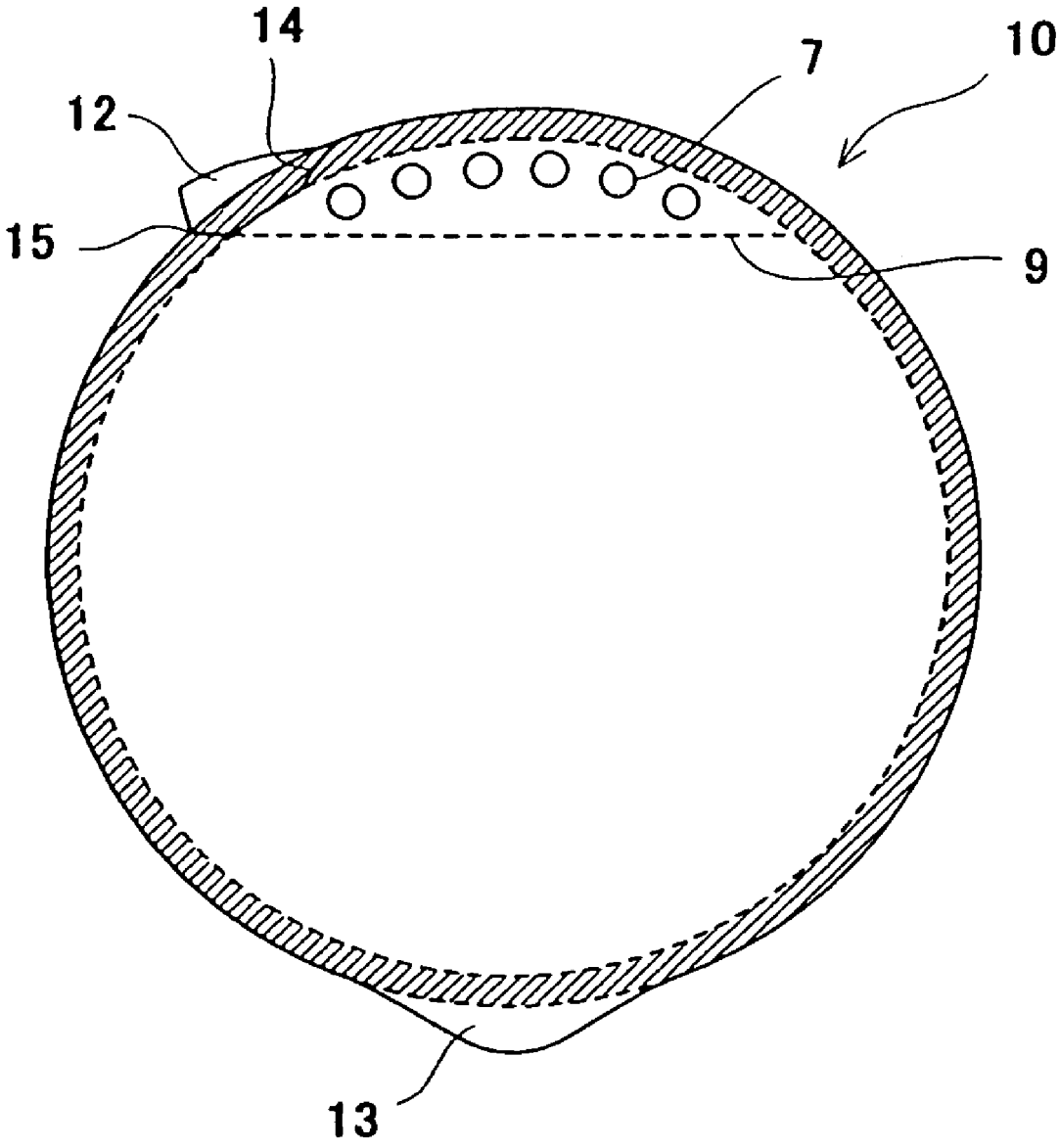
FIG. 8 shows a back view of the lid member according to another embodiment of the present invention.

Then, according to the another embodiment of the present invention, with reference to the back view of the lid member 10 as shown in FIG. 8, a notch 15 is further entered toward the second slit 9 in the circumference edge of the lid member 10. In this case, the notch 15 cut vertical-sectionally and penetrate the lid member 10, and extends about several mm from the circumference edge thereof. Then, preferably, the notch 15 is positioned to overlap with the second slit 9 or to slightly enter into the non-peelable area B.

Lid member 10 illustrated in FIG. 8 has a tab 12 of the layered structure made of the surface sheet and the composite sheet, then one end of a tab-peeling-slit 14 positioned at foot-ends of the tab 12 and made by cutting vertical-sectionally the composite sheet is entered onto the second slit 9. Such slit 14 was prepared by entering molded blades onto the back of the composite sheet 1 (side where the surface sheet 11 is not laminated). Notch 15 is then extends on the second slit 9 from the outer circumference to the starting point of the slit 14. By positioning the notch 15 like that, when the surface sheet 11 is peeled by pulling up the tab 12, the surface sheet 11 is smoothly separated from the composite sheet 1 in order of the notch 15, the slits 14 and 9. If the notch 15 is made simultaneously with the molded blade for the slit 14 or 9, misregistration therebetween may be prevented.

The second slit 9 may be the slit zone 50 as illustrated in FIG. 9. In this case, with reference to FIG. 9(B), the slits 5*a* are arranged in rows as discontinuous pairs of slits which are mutually looking outwardly and have inclination of approximately 20 degrees on the peeling direction (pull direction). Slits 5*a* may be the slit zone 50 by arranging them as two or more rows onto the surface of the surface sheet 11 with the molded blades. Then, when the slits 5*a* are formed as discontinuous pairs of slits which are mutually looking outwardly and are arranged symmetrically, slits can be broken easily, and fragments of the base layer at the broken sites can also be prevented. Although the slits 5*a* may be arranged in two or more rows, in view of ideal peeling, it is preferable to arrange it in 3–5 rows. In this case, preferably, the slit zone 50 is formed on the boundary line (second slit 9) between the easily-peelable area A and the non-peelable area B.

With regard to each of the present lid members aforenoted, as noted later, laminated products having layered structure [consisting of the composite sheet 1 and the surface sheet 11] can be produced by sandlaminating the polyethylene resin layer 4 between the composite sheet 1 and the surface sheet 11. Each of the slits and notch were provided with or without cutting previously the laminated products into leaf-like form, then the lid member 10 is produced through clicking process with or without minutely cutting them previously.

Each of the slits and notch are simultaneously formed at the minute cutting step or the drawing process. Each slit can be formed respectively in the separate process.

For example, the second slit 9 or the slit zone 50 can be made on the surface sheet 11 prior to the lamination. Likewise, the slits 7 and 14 can also be made prior to the lamination.

Components in the lid member of the present invention will be described as follows.

With reference to FIG. 1(A), the composite sheet 1 is a sheet in which metal foil layer 3 and polyethylene resin layer 4 are laminated in this order onto the thermoplastic resin layer 2.

Thermoplastic resin layer 2 is consisting of a resin acting as a sealant and is typically produced by extrusion-lamination, in particular, resin having superior thermal-adhesion to the container flange is preferable. For example, various kinds of polyethylene resin can be used.

Then, as the metal foil layer 3, generally, aluminum foil is usually used in view of aspects, including an economic issue, but not limited thereto, any foil can be utilized as long as foods shelf stability is enhanced by improving insulating properties of the container on light and gases.

Further, the polyethylene resin layer 4 is typically produced through sandlamination using the metal foil layer 3 and the surface sheet 11. These polyethylene resins may, for example, include low-density polyethylene resin, intermediate-density polyethylene resin, polypropylene resin and ethylene-propylene copolymer. In particular, in consideration of the productivities of the lid member, any resin which can be laminated through hot-melt extrusion including polyethylene, ionomer and polypropylene are preferable. Then, these resins can be used in the form of film.

As the surface sheet 11, since an adequate printablity is necessary in its surface, paper is usually used. For example, besides single- or double-coated paper, other coated papers having the equivalent thickness and high-grade papers can also be used appropriately. If it is usable as a surface sheet for the lid by printing the surface thereof, composite papers is also applicable. Then, to avoid tear of the papers at other than where tension is applied at the time of peeling, coated papers wherein synthetic resin film is laminated onto such papers, or composite film of papers and synthetic resin film can also be employed.

As lubricants to form the easily-peelable layer 5, it may include nitrocellulose resin, polyamide resin, polyester resin and combination thereof, but may not be limited thereto. According to the preferable embodiment of the present invention, besides these resins, wax can be incorporated into the lubricant.

As such wax, any wax can be employed as long as they have compatibilities to the aforelisted resins, and may include, for example, polyethylene wax, polyester wax, aliphatic amide wax and combination thereof. Preferably, as stated above, amount of these waxes is from about 5 wt % to about 95 wt % of the lubricant. Application method of the lubricant to print it onto the surface sheet or the composite sheet may include methods of gravure printing, offset printing and letterpress printing.

When the filling varnish layer is employed according to one embodiment of the present invention, it is preferable to adjust an amount of wax to that of about 20 wt % to about 85 wt %. This is because, when the amount of the wax is less than about 20 wt % of the lubricant, of inconvenient phenomenon like peeling due to excessive adhesion of the surface sheet to the varnish layer and the easily-peelable layer. On the other hand, when the amount of the wax is larger than about 85 wt % of the lubricant, interlayer peeling may be observed in the easily-peelable layer 17. Accordingly, in view of keeping adequate peelabilities, it is preferable, as stated above, to adjust an amount of wax to from 20 wt % to about 85 wt % of the lubricant.

A general method of using the container employing the lid member of the present invention will then be described as follows. First of all, the tab 13 is pulled up, and a part of the lid member 10 is peeled from the container flange.

After the hot water is poured into the container, the tab 13 is again bent over toward the flange 21 to reseal the container with the lid member 10. After then, it is left for several minutes to cook the instantly-cookable foods in the container.

Figure 10:
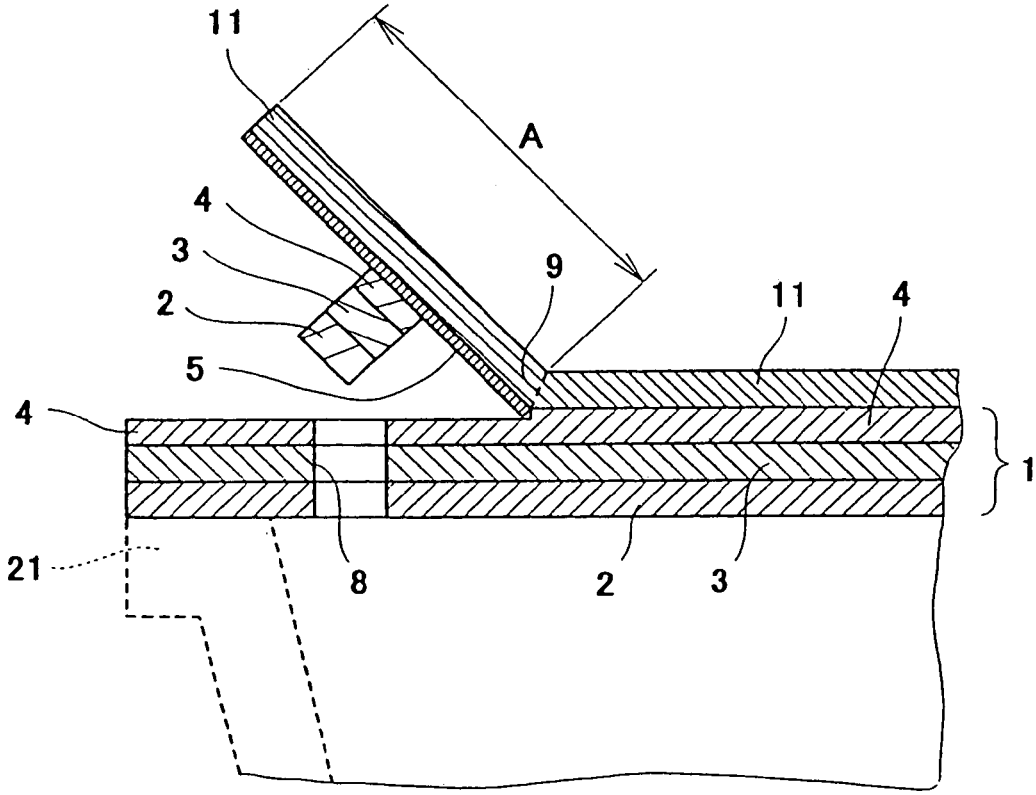
FIG. 10 is a partially cutaway sectional view showing as to how to use a food container employing the lid member according to an embodiment of the present invention.
Figure 11:
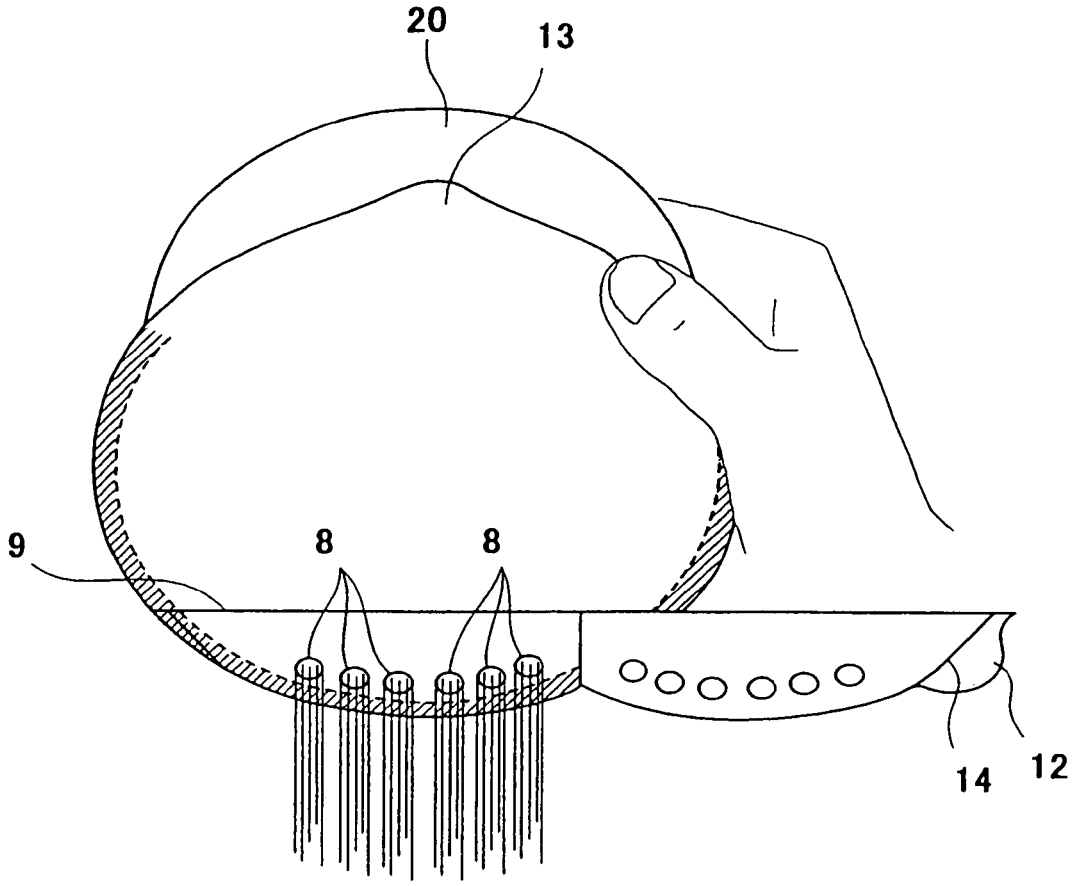
FIG. 11 is a perspective view showing as to how to use a food container employing the lid member according to an embodiment of the present invention.
Figure 13:
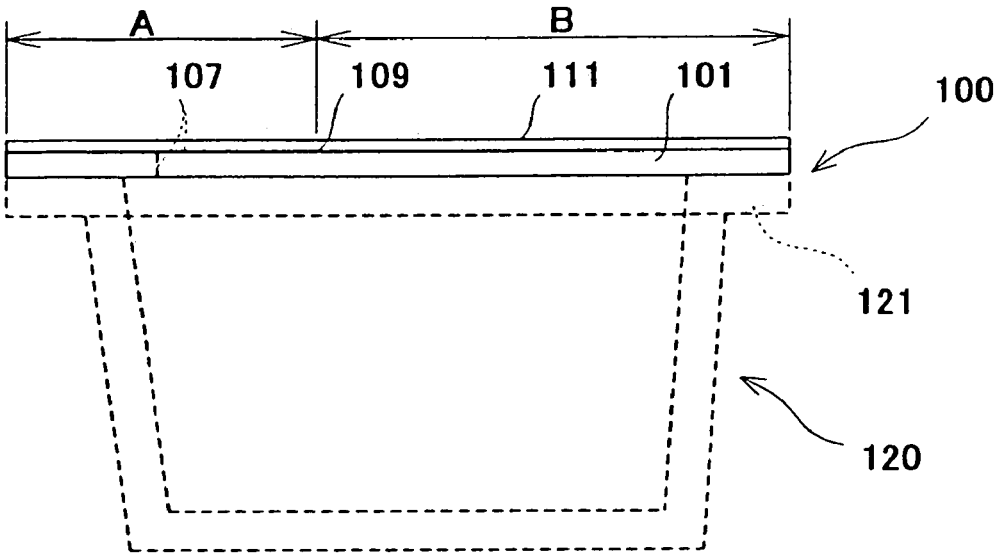
FIG. 13 (PRIOR ART)

Then, as shown in FIG. 10, the surface sheet 11 is peeled from the composite sheet 1 by pulling up the tab 12, and apertures 8 are simultaneously formed in the composite sheet 1 through tear of the slit 7. Thereafter, unnecessary hot water is discharged from the apertures 8 by inclining the container 20 (see, FIG. 11). The lid member 10 is peeled from the flange 21 by pulling up the tab 13, and the cooked foods in the container are eaten.

EXAMPLE

The following experiment was performed to validate effects to be offered by incorporating wax into the lubricant.

Single-coated paper (127.9 g/m$^2$) was obtained as surface sheet and coated surface thereof was used as outer surface. Lubricant was prepared by mixing 50 weight parts of nitrocellulose with 50 weight parts of polyethylene wax. This lubricant was applied to the easily-peelable area A in the back side of the surface sheet in the form of dot-pattern to be a diameter of 3 mm, and was dried.

Then, low-density polyethylene film (sealant) was laminated onto one side of aluminum foil. Molten low-density polyethylene resin was extruded between the other side of the aluminum foil and one side of the surface sheet to be formed easily-peelable layer therein, then they were sand-laminated and the laminated products having layered structure was made. Three apertures were then formed in the easily-peelable area of the composite sheet.

Simultaneously, perforated slits were entered onto the boundary line between the easily-peelable area and the non-peelable area in the surface sheet, and the lid member by the present example was produced by clicking the laminated products into the lid shape.

Control products were made along the above scheme except that the easily-peelable layer was formed by applying varnish containing the nitrocellulose as the main ingredient.

Sealant surface in the lid member is heat-sealed to the container flange by subjecting the example products and the control products respectively, under the condition of heat-seal temperature of 130° C. and heat-seal pressure of 1 kg/cm$^2$. Hot water of predetermined temperature of 20–85° C. were poured into these containers. Peel strength (g/15 mm) evaluated at between the composite sheet and the surface sheet by the particular hot water temperature were summarized in the following Table 1.

TABLE 1

| | PEEL STRENGTH (g/15 mm) | |
|---|---|---|
| HOT WATER TEMPERATURE (° C.) | EXAMPLE PRODUCTS | CONTROL PRODUCTS |
| 85 | 20 | 45 |
| 80 | 20 | 47 |
| 75 | 21 | 46 |
| 70 | 22 | 50 |
| 60 | 29 | 48 |
| 50 | 45 | 57 |
| 40 | 50 | 50 |
| 30 | 49 | 49 |
| 20 | 52 | 48 |

As shown in Table 1, although peel strength were lowered in the example products by the hot water of 70–85° C., relatively stronger adhesion was kept around 20° C. which is substantially room temperature. Accordingly, if an upper limit of the easily-peelable layer in the example products is adjusted, for example, to 60–70 g/l 5 mm, the surface sheet can easily be peeled at the time of eating by heat generated from the hot water. In contrast thereto, peel strength in the control products were not changed by any temperature of hot water poured, namely, there is no ideal temperature-dependency on the peel strength (adhesion) in the control products.

INDUSTRIAL APPLICABILITY

According to the lid member of the present invention, a container can be hermetically closed by adhering the lid member to the flange. Apertures to discharge the hot water are then made by peeling, from the lid member in the hermetically closed container, the surface sheet in the easily-peelable area. Since the hot water used to cook the foods in the container are discharged from these apertures, the lid member of the present invention is useful for instantly cookable foods like those to be cooked by pouring hot water thereto and removing them, in particular, for instantly cookable chow mein, spaghetti or the like.

In such lid members, the surface sheet is adhered to the composite sheet at an area which is smaller than the area cut for apertures in the composite sheet 1. By forming the cut area for apertures like that, any fragment might not be entered into the container, then the registration of the cut area with the contact area would be easy, and production efficiencies can be raised. Preferably the area of adherence between the surface sheet 11 and the composite sheet 1, at the opening area ranges from about 1/9 to about 4/9 of the cut area to form apertures, while the inner diameter of the contact area for the circular apertures preferably ranges to from about R/3 to about 2R/3, if the inner diameter of the cut area for the apertures is designated as R.

According to the lid member of the present invention, when the lubricant is applied in the form of pattern and the easily-peelable layer in the easily-peelable area are formed, an unpredictable irregular peeling can be avoided between the composite sheet and the surface sheet due to pressure or impact by the molded blades at the vertical-sectionally entering the circular slit into the composite sheet, thereby, qualities of the lid member can easily be kept. Then, by applying the lubricant in the form of pattern like that, if an area for the apertures in the easily-peelable area is formed without non-applied area of the lubricant, composite sheet at the apertures would not be entered into the container. Area to be applied with the lubricant is also adjustable, therefore, adhesion between the surface sheet and the composite sheet can also easily be adjustable, and less amount of the lubricant is necessary.

When the easily-peelable layer along the slit separating the easily-peelable area and the non-peelable area in the lid member of the present invention is formed by applying the lubricant in the solid form, peel strength of the surface sheet to the composite sheet 1 become less at the slit, therefore, the surface sheet can easily be peeled at the slit. By employing the broader easily-peelable layer as a hallmark, registration on relative positions at the laminating of the surface sheet onto the composite sheet can easily be realized, and production loss on the lid member would be reduced.

When the easily-peelable layer is formed by applying the lubricant in the solid form adjacent to the tab formed integrally with the surface sheet, necessary strength to peel the surface sheet is reduced, and the surface sheet can easily be peeled. In addition thereto, when an easily-peelable layer around the circumference edge except at adjacent to the tab is formed by applying thereto the lubricant in the form of pattern, lifting of the surface sheet can be relaxed at the heat-sealing of the lid member onto the container.

Then, by incorporating wax into the lubricant, wax is softened and liquidized by heat generated from the hot water poured into the container, then peel strength between the surface sheet and the composite sheet is reduced, and the surface sheet can easily be peeled. Thereby, width of the easily-peelable layer can be broader, it may contribute to improve the productivities of the lid member.

Further, by putting the varnish layer (filling varnish layer) between the surafce sheet and the easily-peelable layer, absorption of the lubricant into the surface sheet will be prevented, the surface sheet will then be peeled without interlayer peeling. Thereby, apertures of identical inner diameter can be formed, the surface sheet can then be peeled without generating any fragment (paper fragment) of the sheet.

According to the lid member of the present invention, since the notch is cut into the outer circumference of the lid member, the surface sheet in the easily-peelable area can successively and smoothly be peeled from the composite sheet by using them as a trigger for peeling the surface sheet.

In particular, if the lid member employ a slit zone in which a pair of discontinuous slits inclinates mutually outwardly, the surface sheet can be peeled very easily.

What is claimed is:

1. A lid member for a food container having a layered structure in which a surface sheet is laid on a composite sheet, the lid member comprises:

an easily-peelable area comprising an easily-peelable layer made by applying a lubricant between the surface sheet and the composite sheet, an opening area placed within the easily-peelable area to form apertures therein, and a non-peelable area placed adjacent to the easily-peelable area, and a first slit which cuts the composite sheet vertical-sectionally and forms the apertures in the opening area, and a second slit which cuts the surface sheet vertical-sectionally and is laid along the boundary line between the easily-peelable area and the non-peelable area, and the lid member is further characterized in that the surface sheet is adhered to the composite sheet at the opening area without the lubricant through an area which is smaller than the apertures formed within the composite sheet, and said easily-peelable layer is formed by applying the lubricant in the form of a pattern.

2. The lid member according to claim 1, wherein said easily-peelable layer is formed by applying the lubricant in the form of a dot-pattern.

3. The lid member according to claim 2, wherein the dot diameter of said lubricant applied in the form of a dot-pattern is from about 0.5 mm to about 1.5 mm.

4. The lid member according to claim 1, wherein said easily-peelable layer is formed by applying the lubricant in the form of a mesh-pattern.

5. The lid member according to claim 4, wherein the mesh size of said lubricant applied in the form of a mesh-pattern is from about 0.3 mm to about 0.5 mm.

6. The lid member according to claim 1, wherein the area of applied lubricant occupies from about 60% to about 90% of the easily-peelable layer.

7. The lid member according to claim 1, wherein said lid member further comprises an easily-peelable layer formed by applying lubricant in solid form along said second slit.

8. The lid member according to claim 1, wherein said lid member further comprises a tab to open said apertures said tab formed at a circumferential edge of said easily-peelable layer.

9. The lid member according to claim 8, wherein the easily-peelable layer, in the circumferential edge of said easily-peelable area at an adjacent portion to said tab is formed by applying lubricant in solid form, and;

the easily-peelable layer in the circumferential edge of said easily-peelable area, except at said adjacent portion to said tab is formed by applying lubricant in the form of a pattern.

10. The lid member according to claim 1, wherein said lubricant comprises wax ill an amount of from about 5 wt % to about 95 wt % of said lubricant.

11. The lid member according to claim 10, wherein said wax is selected from the group consisting of polyethylene wax, polyester wax, aliphatic amide wax, and a combination thereof.

12. The lid member according to claim 1, wherein said lid member further comprises filling varnish disposed between said easily-peelable layer and said surface sheet.

13. The lid member according to claim 1, wherein said lid member further comprises a notch, cut from the surface sheet to the composite sheet, on said second slit or adjacent thereto, within a circumferential edge of the lid member.

14. The lid member according to claim 1, wherein said second slit is a slit zone wherein a pair of discontinuous slits, inclined mutually outwardly, provide at least one row of slits.

* * * * *